US005827374A

United States Patent [19]

Mansur

[11] Patent Number: 5,827,374

[45] Date of Patent: Oct. 27, 1998

[54] PROCESS FOR INTEGRATED RECYCLING OF CLEANING SOLUTION IN INDUSTRIAL WASHING EQUIPMENT

[75] Inventor: Pierre G. Mansur, Miami, Fla.

[73] Assignee: Mansur Industries Inc., Miami, Fla.

[21] Appl. No.: 771,640

[22] Filed: Dec. 20, 1996

Related U.S. Application Data

[63] Continuation of Ser. No. 521,624, Aug. 31, 1995, abandoned, which is a continuation-in-part of Ser. No. 394,290, Feb. 24, 1995, Pat. No. 5,549,128.

[51] Int. Cl.[6] ..... B08B 7/04

[52] U.S. Cl. ..... 134/12; 134/10

[58] Field of Search ..... 134/12, 107, 108, 134/109, 111, 110, 56 R, 10, 34, 40, 42, 35, 18, 21

[56] References Cited

U.S. PATENT DOCUMENTS

| | | | |
|---|---|---|---|
| 2,352,356 | 5/1944 | Albertson | 134/109 |
| 3,610,260 | 10/1971 | Kearney | 134/107 |
| 3,707,404 | 12/1972 | Carlson et al. | 134/109 |
| 4,051,858 | 10/1977 | Mele | 134/111 |
| 4,122,861 | 10/1978 | Lee | 134/109 |
| 4,433,698 | 2/1984 | Blaul | 134/56 R |
| 4,443,269 | 4/1984 | Capella et al. | 134/12 |
| 4,505,284 | 3/1985 | Kyatt | 134/109 |
| 4,856,061 | 8/1989 | Fowler et al. | 134/108 |
| 4,929,312 | 5/1990 | Westcott | 134/12 |
| 5,180,438 | 1/1993 | Hockh et al. | 134/12 |
| 5,232,299 | 8/1993 | Hiss | 134/104.4 |

*Primary Examiner*—Jill Warden
*Assistant Examiner*—Alexander Markoff
*Attorney, Agent, or Firm*—Robert M. Downey, P.A.

[57] ABSTRACT

In an apparatus for washing automotive, aviation, marine and other general parts, equipment or articles with a liquid cleaning solution, there is provided a process for integrated recycling of the cleaning solution including: containing a charge of the cleaning solution in a holding tank; pumping the solution into a wash basin for washing parts therein; returning the solution to the holding tank; periodically heating the cleaning solution, after becoming contaminated from use, to a predetermined temperature to produce vapors and separate contaminants therefrom; condensing the vapors to yield purified liquid cleaning solution; and returning the purified cleaning solution to the holding tank for subsequent use for washing parts.

13 Claims, 5 Drawing Sheets

PROCESS FOR INTEGRATED RECYCLING OF CLEANING SOLUTION IN INDUSTRIAL WASHING EQUIPMENT

BACKGROUND OF THE INVENTION

This application is a continuation application of patent application Ser. No. 08/521,624 filed Aug. 31, 1995, now abandoned, which is a continuation-in-part of patent application Ser. No. 08/394,290, filed Feb. 24, 1995, which is now issued U.S. Pat. No. 5,549,128.

FIELD OF THE INVENTION

The present invention relates to a process for recycling cleaning solution for reuse, and more particularly, to a process for purifying contaminated cleaning solution in a general washing apparatus.

DESCRIPTION OF THE RELATED ART

In many industries, including the automotive, aviation, and marine industries, it is often necessary to wash a wide variety of parts, equipment and other articles with a liquid cleaning solution in order to remove grease, oil, dirt, and other contaminants. Typically, volatile solvents or aqueous cleaning solutions are used by most maintenance and repair facilities.

Presently, the most commonly used means to wash small parts, equipment and other articles is a sink which is removably supported on the top of a drum filled with cleaning solvent. The solvent is pumped to a spout in the sink, whereupon the discharged solvent is used to rinse parts in the sink. After washing, the solvent is drained back into the drum for subsequent use during washing operations. In a short period of time, the charge of cleaning solvent contained in the drum, which is reused for washing, becomes contaminated with oils, grease, dirt, particulate, and other contaminants which are rinsed from the parts being cleaned. The contaminated solvent is continuously used during washing operations until the drum of contaminated solvent is replaced with a new drum containing fresh solvent. The replacement of solvent is ordinarily provided by a service, which removes the contaminated drum and replaces a new drum of fresh solvent on a replacement cycle which may be every 4 to 8 weeks. The drum of contaminated solvent, which is removed, must be disposed or recycled of by the service in a manner which complies with EPA guidelines. Accordingly, large volumes of contaminated cleaning solvent are constantly being transported to a central treatment facility for disposal. This procedure is inefficient, costly, and time-consuming, and often fails to comply with the EPA contaminant disposal guidelines. Further, the users of this service find themselves performing parts cleaning operations using dirty, contaminated solvent between scheduled solvent replacement dates.

The present invention eliminates the problems of disposal of cleaning solutions which exists in virtually all industrial cleaning industries.

SUMMARY OF THE INVENTION

The present invention is directed to a process for integrated recycling of contaminated cleaning solution in a parts washing apparatus.

In particular, the present invention provides for a recycling process for purifying contaminated cleaning solution in a washing apparatus, providing purified, non-contaminated cleaning solution on demand for use during washing operations.

The washing apparatus which is used in accordance with the process of the present invention may include a wash basin having an at least partially surrounding wall structure defining a splash guard and a floor which slopes slightly downward from the sides, front and rear towards a centrally disposed drain to facilitate recovery of cleaning solution after use. Once the cleaning solution has passed through the drain and a filter, the cleaning solution returns to a holding tank. A pump recirculates the cleaning solution from the holding tank to a spout which discharges the cleaning solution into the wash basin for rinsing articles during a wash cycle.

In one embodiment, the washing apparatus may include a distillation chamber within which contaminated solution is heated to produce vapors in accordance with the process of the present invention. In this instance, a containment valve is opened, releasing the cleaning solution from within the holding tank into the distillation chamber. Once the cleaning solution has completely drained into the distillation chamber, the containment valve is closed and the cleaning solution is heated to the desired boiling point, resulting in the separation of contaminants from the vapors. The vapors are directed through a condenser where they are condensed to a liquid state to produce fresh, non-contaminated or purified cleaning solution. This fresh cleaning solution is then lead to the holding tank, or a secondary holding tank, for subsequent use during the wash cycle.

A vacuum pump may be used to create a vacuum in the distillation chamber, thereby lowering the boiling point temperature of the cleaning solution. In the preferred embodiment, a liquid ring vacuum pump is used to transfer the purified cleaning solution from the distillation chamber to the secondary holding reservoir, enabling contaminated cleaning solution in the primary holding reservoir to be released into the distillation chamber. The fresh cleaning solution, once transferred from the secondary holding reservoir to the primary holding reservoir, can be used to operate the liquid ring vacuum pump.

To prevent cleaning solution vapors from escaping to atmosphere from within the holding tank, a valve may be provided near the drain between the wash basin and the holding tank. During periods of non-use for washing, the valve is closed to contain vapors within the holding tank. In a further embodiment of the present invention, the cleaning solution in the holding tank may be cooled to a predetermined temperature, thereby minimizing vapors.

Accordingly, with the foregoing in mind, it is a primary object of the present invention to provide a process for integrated recycling of contaminated cleaning solution in a washing apparatus so as to provide a user of the apparatus with "on-demand" pure cleaning solution on a regular basis for industrial washing applications.

It is a further object of the present invention to provide a process for recycling cleaning solution in a washing apparatus which eliminates the need for replacement and disposal of large volumes of contaminated cleaning solution, while providing a practical and economical means of complying with EPA contaminant disposal guidelines.

It is yet another object of the present invention to provide a process for recycling cleaning solution in a washing apparatus, wherein the apparatus may be provided with a second holding tank so that one charge of cleaning solution can be used for washing while another charge of cleaning solution is being purified.

It is still a further object of the present invention to provide a process for on-site recycling of cleaning solution in a washing apparatus, thereby eliminating the need for transport and/or disposal of large volumes of contaminated cleaning solutions.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
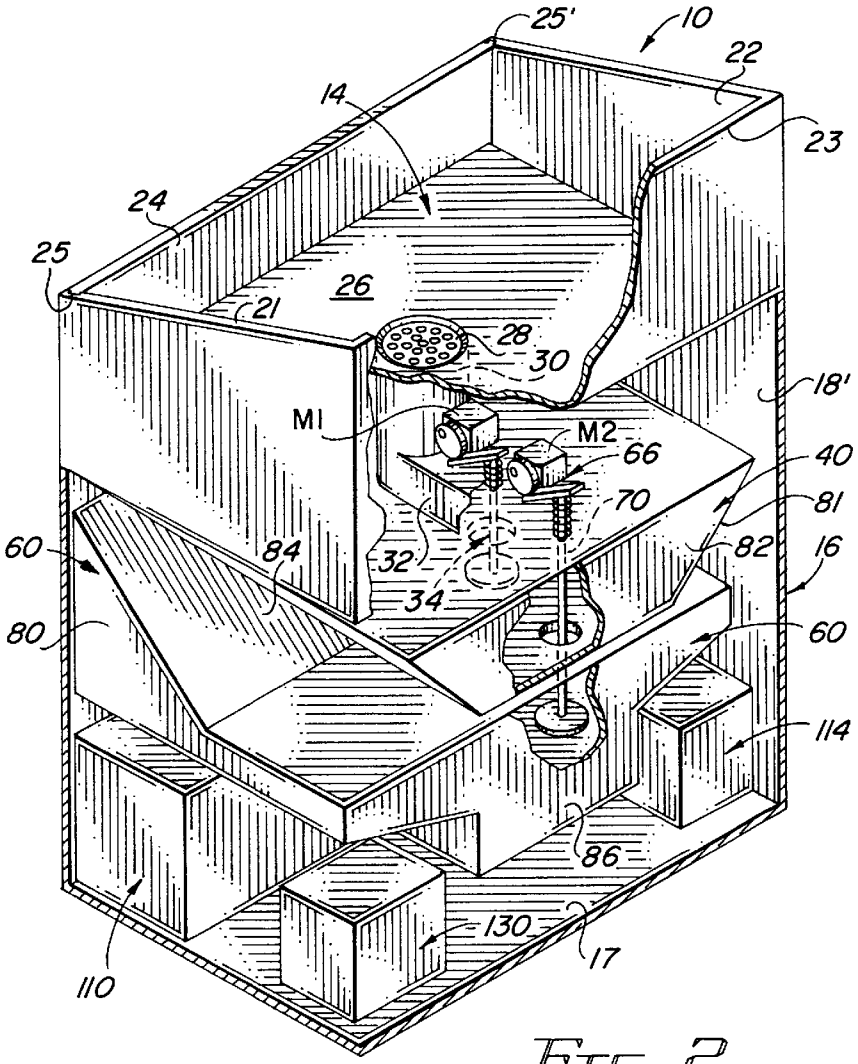
FIG. 2 is a rear, top perspective view, in partial cutaway, illustrating the primary structural components of the apparatus.

Referring to the several views of the drawings, there is generally illustrated a general washer apparatus 10 which is specifically structured to perform integrated recycling of solvent in accordance with the present invention. The apparatus 10 may be provided with a cabinet 12 including an upper portion defining a wash basin 14 and a lower portion 16 including a base 17, side walls 18, 18', rear wall 19 and a front wall 20. The wash basin 14 includes side wall portions 21, 22 and a rear wall portion 23 partially surrounding the wash basin 14, and defining a splash guard. A front wall panel 24 is removably fitted within opposite channels 25, 25' formed in the opposite side wall portions 21, 22 of the wash basin 14. During washing operations, the front wall panel 24 can be pulled upwardly and removed from a remainder of the apparatus 10 so that access to the wash basin 14 is unobstructed from a front of the apparatus 10.

The floor 26 of the wash basin 14 is preferably sloped from the sides, rear, and front, downwardly towards a central zone where there is located a drain 28, including a drain plate 29, through which cleaning solution drains after use for washing articles in the wash basin 14. After passage through the drain plate 29, the cleaning solution is directed through a return canal 32 which leads to a cleaning solution holding tank 40. A vapor containment valve assembly 34 is provided at the connection of the return canal 32 to the holding tank 40. During periods of non-use, the valve assembly 34 is normally disposed in seated, blocking relation to the passage at the connection of the return canal 32 to the holding tank 40 so that vapors within the holding tank 40 cannot escape to atmosphere through the return canal 32. The holding tank 40 is sized and configured to contain a predetermined amount of cleaning solution therein.

Figure 1:
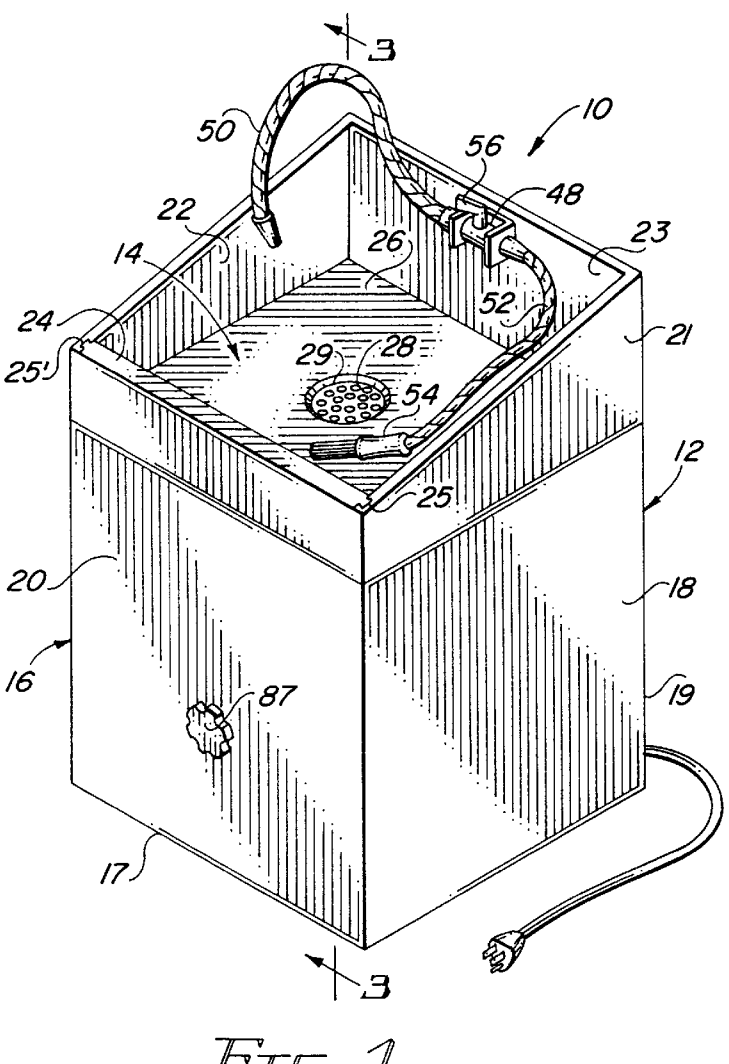
FIG. 1 is a front, top perspective view of the washer apparatus used to perform the process of the present invention.

A solution pump 44, provided within the holding tank 40, recirculates the cleaning solution in the holding tank 40 through a return conduit 46 leading to a three-way valve 48 interconnecting between the return conduit and a spout 50 and hose 52 having a wash brush 54 attached to an end thereof. A valve lever 56 facilitates operation of the valve to direct flow of cleaning solution to the spout 50 and/or the hose 52, or other discharge means such as spray nozzles, for washing articles in the wash basin 40 (see FIGS. 1, 3 and 4). The brush 54 attached to the hose 52 is specifically designed to permit fluid flow therethrough so that articles may be brushed and simultaneously rinsed with cleaning solution to remove accumulated grease, dirt and other contaminants from the articles being washed. Alternatively, one or more spray nozzles or fittings may be fitted within the wash basin 40 to spray cleaning solution, possibly under pressure, in a dispersed array to wash articles that have been placed in the wash basin. An attachment coupling or like means may be provided to enable interchangeable attachment of specialized fittings and/or nozzles for washing specific types of equipment or articles, such as paint spraying equipment. In either embodiment, the three-way valve 48 is not necessary, but can be installed if desired. Once discharged from the spout 50 and/or brush 54, or spray nozzles, the cleaning solution returns to the holding tank 40 through the drain 28 and return canal 32. An electric switch is provided and is easily accessible on an exterior of the apparatus 10 (not shown for purposes of clarity) to facilitate deactivation of the pump 44 during periods of non-use. To this point, a wash cycle has been described. The wash cycle continues during washing operations.

After a predetermined period of time, or at such intervals as may be selectively determined, the cleaning solution contained within the holding tank 40 (now contaminated after being used for washing various articles in the wash basin) is released into a distillation chamber 60.

Figure 3:
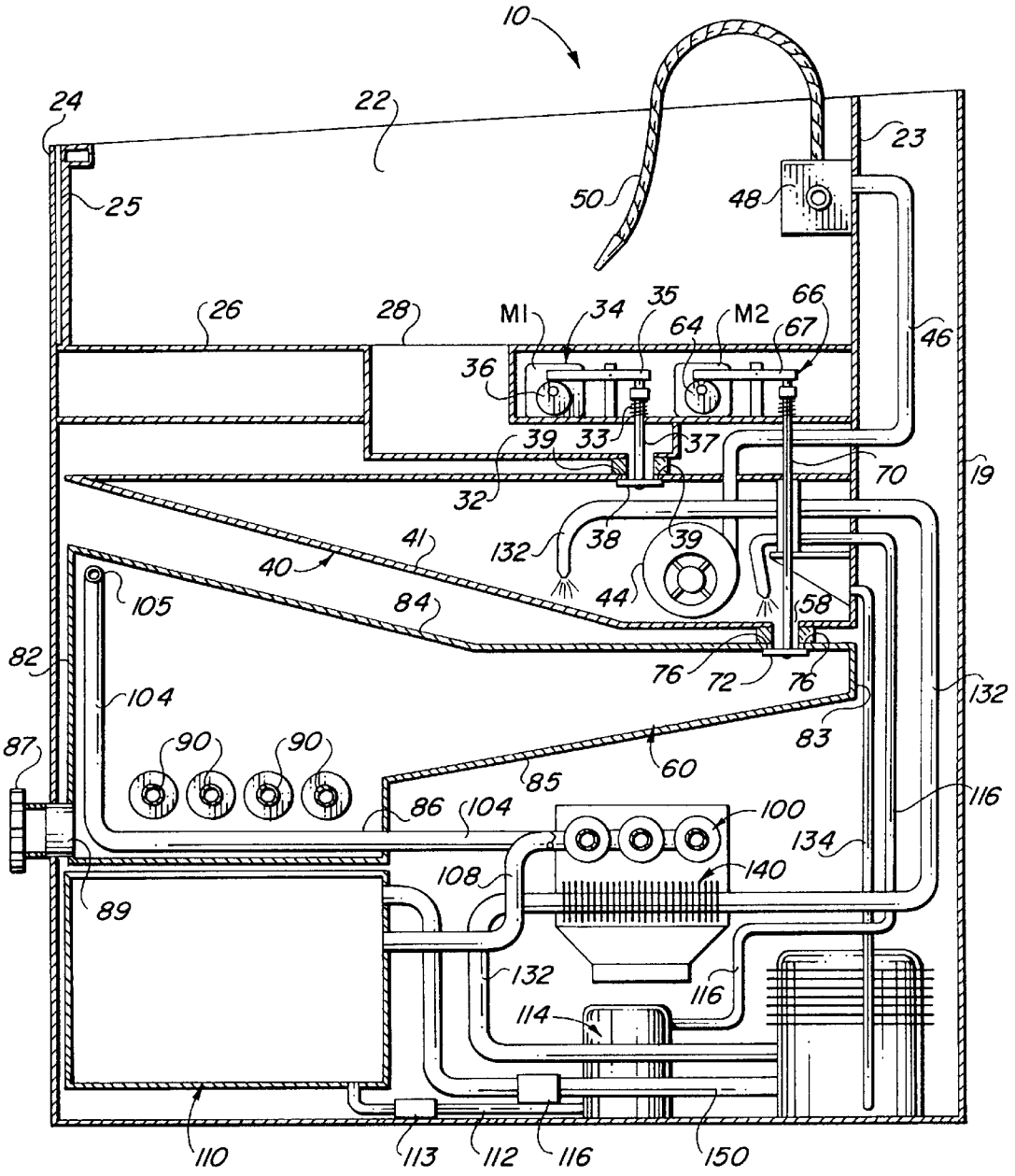
FIG. 3 is a side elevation, in partial section, illustrating the structure and interconnection of the components of the apparatus.
Figure 4:
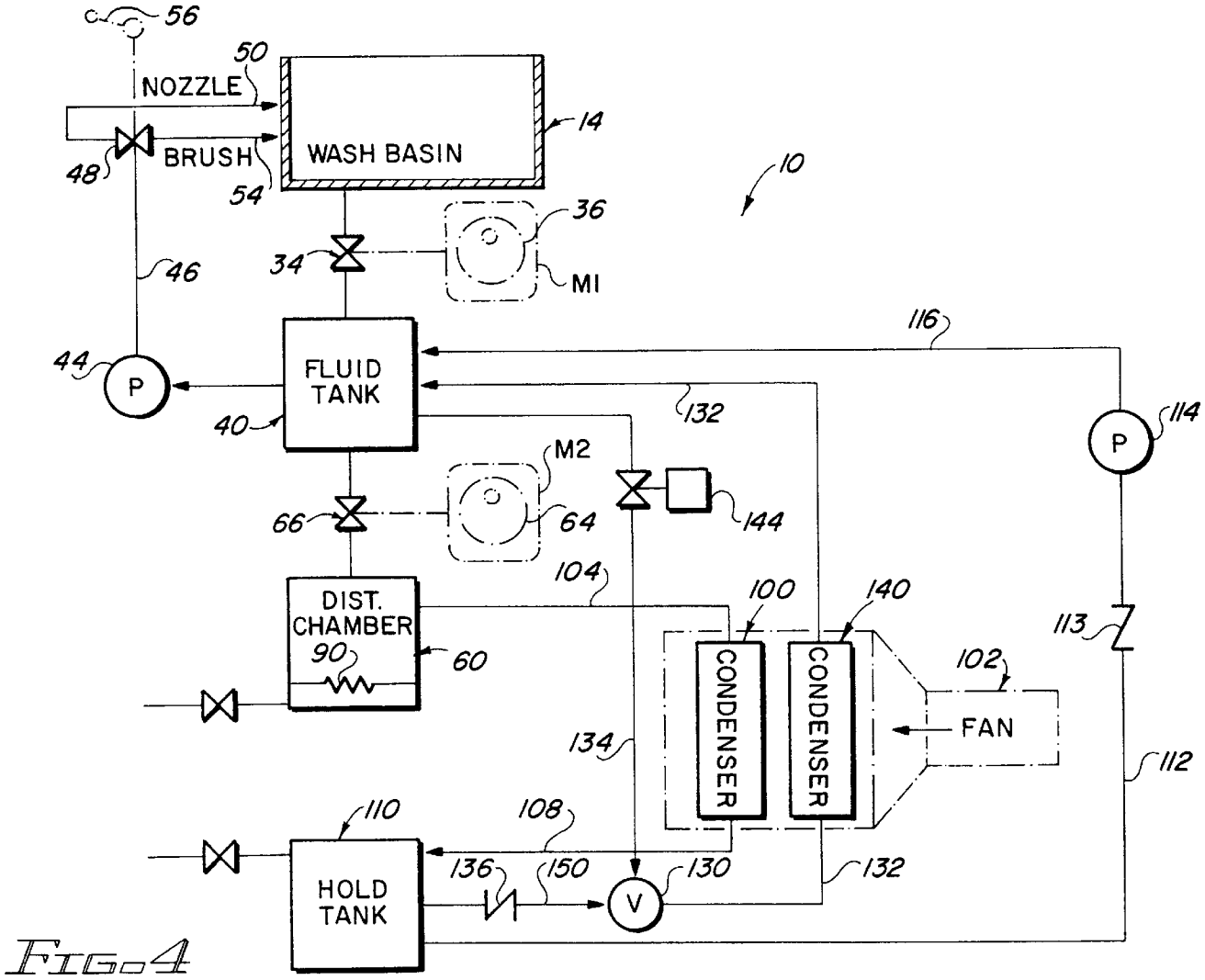
FIG. 4 is a schematic diagram illustrating the functional relationship between the various components of the apparatus.
Figure 5A:
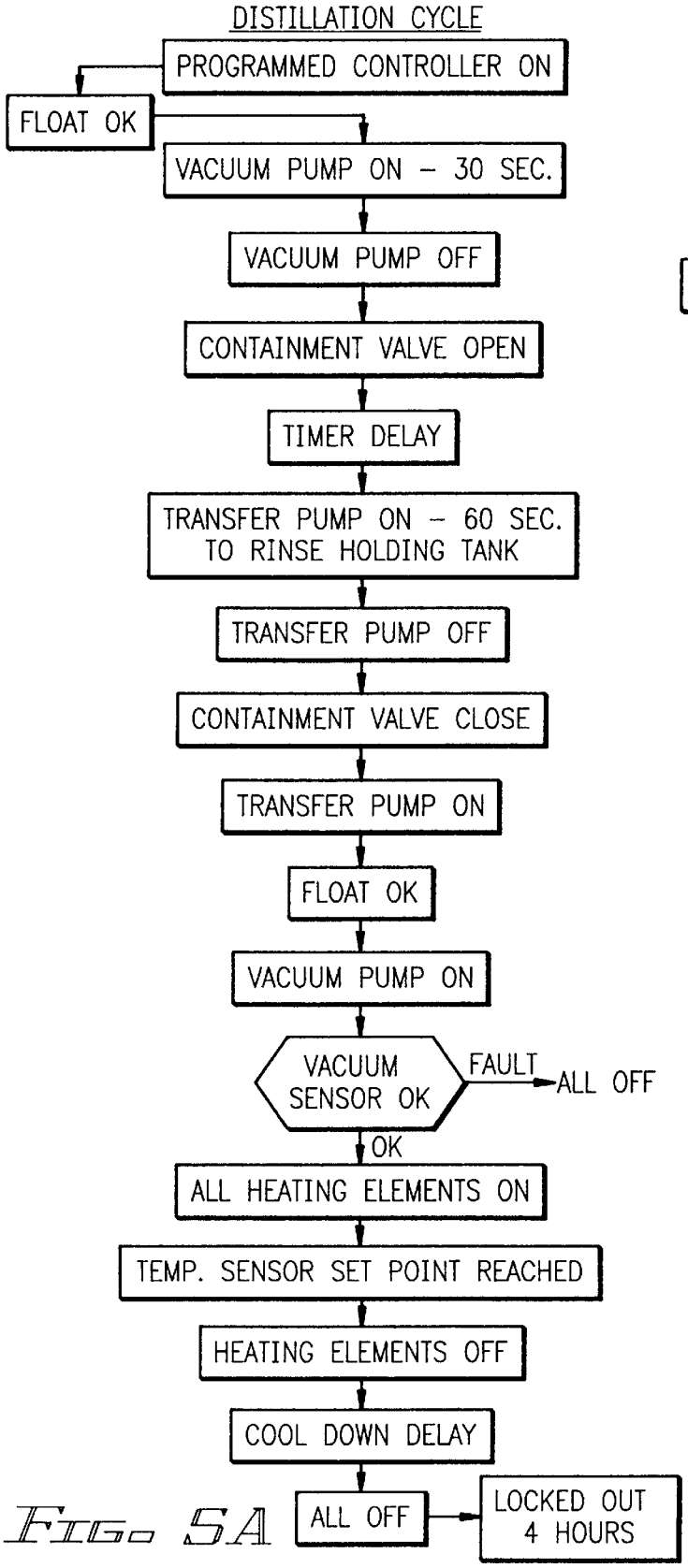
FIG. 5A is a flow diagram illustrating a sequence of the distillation cycle of the process of the present invention.
Figure 5B:
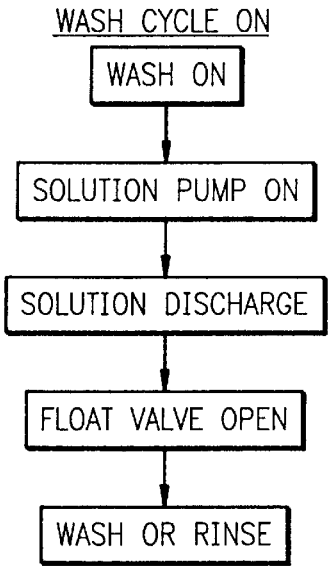
FIG. 5B is a flow diagram illustrating a sequence of activation of the wash cycle of the process.
Figure 5C:
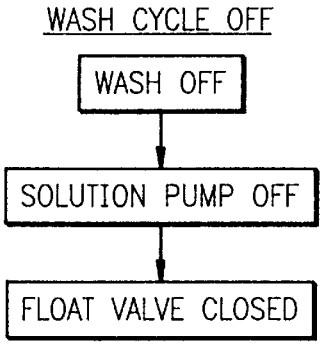
FIG. 5C is a flow diagram illustrating the sequence of deactivation of the wash cycle.

Referring to FIGS. 3, 4 and 5, at the initiation of a distillation cycle, a vacuum pump 130 is activated for approximately 30 seconds and thereafter turned off. A vacuum controlled containment valve assembly 66 is activated, resulting in upward movement of valve stem 70 to release valve head 72 from engagement with a valve seat 76, upon opening of the containment valve assembly 66, the contaminated cleaning solution in the holding tank 40 is released through a transfer canal 58 and into the distillation chamber 60. The bottom 41 of the holding tank 40 is specifically configured to slope toward the containment valve assembly 66, as seen in FIG. 3, so that upon opening of the valve assembly 66, the cleaning solution will readily flow through the transfer canal 58 and into the distillation chamber 60. After a timed delay, a transfer pump 114 is activated for approximately 60 seconds, drawing clean solution from a lower holding tank 110 which is discharged through spray nozzles onto the valve seat 76 and the bottom 41 of the holding tank 40 in order to wash sediment which has settled on the bottom 41 into the distillation chamber 60, leaving the now empty holding tank 40 clean and generally free of contaminants.

The distillation chamber includes side walls 80, 81, a front wall 82, rear wall 83, a bottom 85, and a ceiling 84 and may be insulated on all sides, as well as the top and bottom, to maintain heat therein and to prevent transfer of heat to other components, including the cabinet walls. The bottom 85 of the distillation chamber 60 is specifically structured and configured to slope downwardly towards a lower central zone 86 so that sediment and other contaminants gather at the central zone 86, facilitating easier cleaning thereof. A removable cap 87 on the front of the apparatus fits in covering, sealing relation to a port 89 formed through the front wall of the distillation chamber 60 near the lower central zone 86. Removal of the cap 87 facilitates access to an interior of the distillation chamber 60, enabling accumulated contaminants in the lower central zone to be periodically removed. A tool, such as a spade on a rod, can be used to reach through the port 89 and scrape the bottom of the distillation chamber 60, pulling the accumulated sediment and other contaminants out through the port. Once cleaned, the cap 87 is replaced in covering, sealed relation on the port 89 so that liquid and vapors do not escape therefrom during the distillation process.

A plurality of heating elements 90 are provided within the distillation chamber 60 to heat the cleaning solution to a predetermined temperature sufficient to produce vapors for distillation. The heating elements 90 may be comprised of electrically operated elongate elements each individually fitted within a tube. The tubes extend within an interior of the distillation chamber 60, so that the tubes are surrounded by the cleaning solution, thereby providing an efficient heat transfer medium between the heating elements 90 and the cleaning solution.

A condenser 100 is positioned and disposed within a cooling zone and is cooled by a fan 102. The condenser 100 includes a first conduit 104 extending to and terminating at an open distal end within an upper portion of the distillation chamber 60. The open end 105 of the conduit 104 is specifically positioned and disposed for receipt of vapors therethrough. The vapors are thereafter lead through the conduit 104 to the condenser 100, wherein the vapors are condensed to yield fresh, non-contaminated cleaning solution. A second conduit 108 extends from the condenser 100 to a second lower cleaning solution holding tank 110. The distilled, purified cleaning solution is directed into the lower holding 110 for temporary storage therein. At this point, there is a separate charge of cleaning solution contained in the upper holding tank 40 for use during the wash cycle. When the charge of cleaning solution in the upper holding tank 40 is contaminated from washing operations, and recycling is needed or desired, the charge of cleaning solution is released from the holding tank 40 into the distillation chamber 60, in a manner as set forth above. Thereafter, the transfer pump 114 is activated to draw fresh cleaning solution from the lower holding tank 110 and through a transfer line 116. The transfer pump 114 is interconnected to the lower holding tank 110 by line 112 having a check valve 113 therebetween, to hold vacuum. The cleaning solution drawn through transfer line 116 is dispersed into the upper holding tank 40 and onto the bottom 41 thereof as well as the valve assembly 66, to remove sediment from the tank bottom 41 and valve seat 76. After rinsing the holding tank 40, a vacuum actuated valve control member 67 closes the containment valve assembly 66 to seal off the distillation chamber 60. At this point, the transfer pump 114 is activated, resulting in the purified, non-contaminated cleaning solution in the lower holding tank 110 being transferred into the upper holding tank 40. When the charge of purified cleaning solution has been completely transferred from the lower tank 110 to the upper tank 40, liquid ring vacuum pump 130 is activated. The purified cleaning solution is drawn through an intake line 134 from the holding tank 40 to the vacuum pump 130, where it is thereafter discharged through output line 132, and through a second condenser 140 for cooling prior to returning to the holding tank 40. Operation of the vacuum pump 130 results in a suction through vacuum line 150 leading to an upper portion of the lower holding tank 110. Continued operation of the vacuum pump 130 results in a negative pressure in the lower holding tank 110, the condenser 100, and the distillation chamber 60. In this manner, the temperature at which the cleaning solution will vaporize is substantially lowered, resulting in greater efficiency in the operation of the apparatus 10. To hold the negative pressure in the distillation chamber 60 and the lower holding tank 110, a second check valve 136 is provided along the vacuum line 150.

Referring to FIG. 4, a solenoid valve 144 is provided in the fluid intake line 134 leading from the holding tank 40 to the vacuum pump 130. Once a negative pressure is achieved in the distillation chamber 60, the solenoid valve 140 is closed and the vacuum pump 130 is deactivated. Thus, the solenoid valve 144 prevents the cleaning solution from draining from the holding tank 40 and backing up into the vacuum pump 130. The contaminated cleaning solution in the distillation chamber 60 is thereafter heated and vaporized, as described above, resulting in the distilled, purified cleaning solution being collected in the lower holding tank 110. The fresh, recycled cleaning solution in the lower holding tank 110 is allowed to cool as all components relating to the distillation cycle are turned off. A lockout period of approximately four hours is maintained, preventing activation of the distillation cycle until the end of the lockout.

A program controller interconnects with the various components of the apparatus and controls the sequence of operation of the components throughout the distillation cycle, as shown in FIG. 5A.

The apparatus 10 may be further provided with a cleaning solution cooler to cool the cleaning solution in the upper holding tank 40 and maintain it at a predetermined desired temperature. In this manner, evaporation of the cleaning solution in the upper holding tank can be controlled, especially in warmer climates, preventing vapors from escaping to atmosphere. In accordance with a preferred embodiment of the present invention, the means for cooling the cleaning solution includes a compressor 170 having a condenser coil 172 extending therefrom and leading to an evaporator or cooling coil 174. The cooling coil 174 extends within the interior of the holding tank 40 to cool the cleaning solution contained therein by absorbing heat therefrom. The evaporator coil 174 leads back to the compressor 170. A temperature sensor switch can be interconnected to the compressor for activation thereof at a predetermined cleaning solution temperature level so that the cooling means will be activated when the temperature of the cleaning solution rises above a predetermined set temperature.

Figure 6:
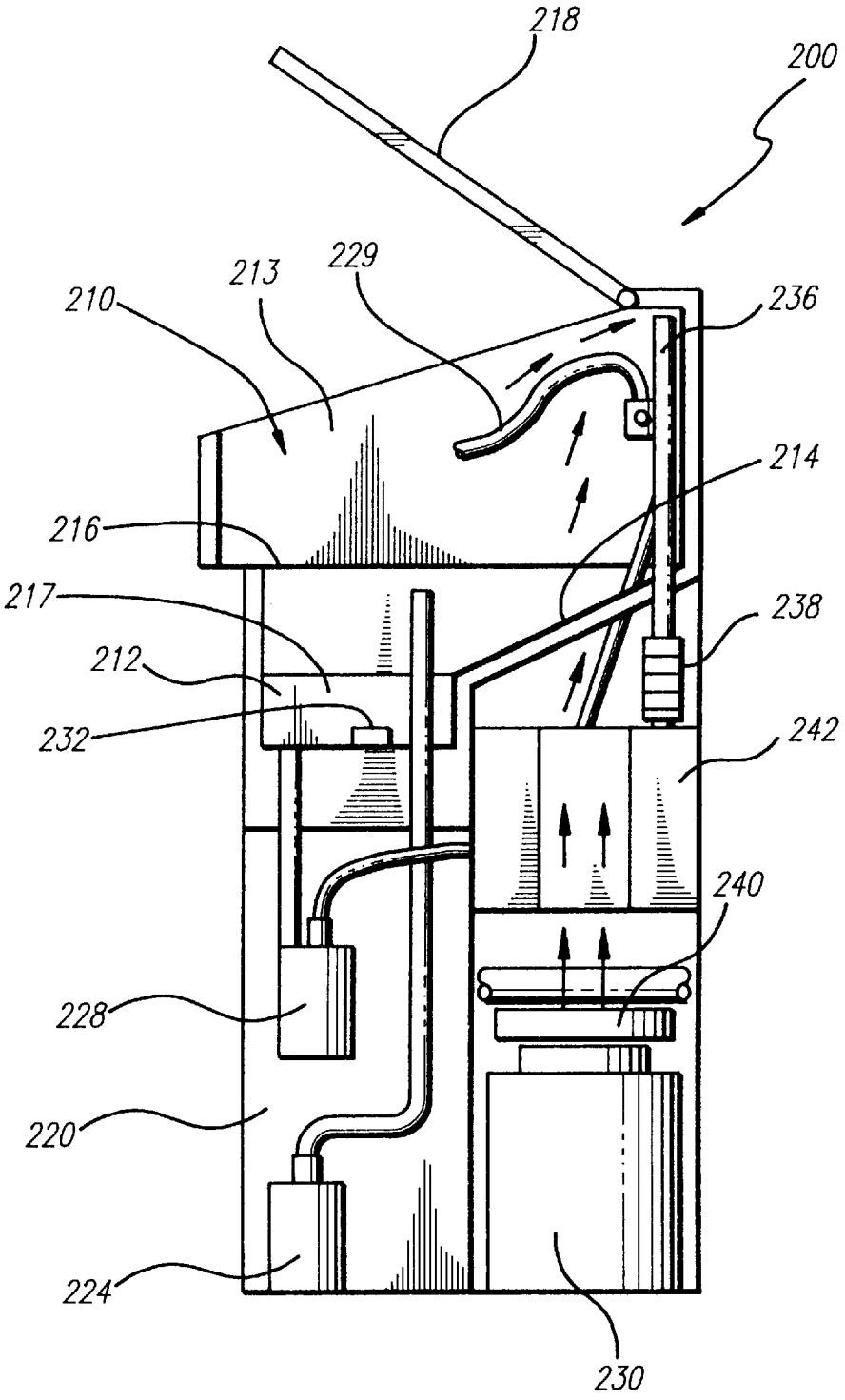
FIG. 6 is a side elevation of an alternative washing apparatus used to perform the process of the invention.

Referring to FIG. 6, there is illustrated an alternative washing apparatus adapted for integrated recycling of cleaning solution in accordance with the process of the present invention. The washing apparatus 200, as seen in FIG. 6, includes an upper chamber 210 including a lower basin 212, an upper work area 213 separated by a grading or mesh floor 216. The basin 212 includes a sloped floor 214 so that cleaning solution which is deposited in the basin 212 is directed towards a lower portion 217 thereof. A lid 218 is movable between an open position and a closed position. The lid 218 is normally left open during washing operations. During periods of non-washing or recycling of cleaning solution, the lid 218 is closed so that the upper work area 213 and basin 212 become a sealed chamber.

Fresh, purified solvent is contained in a clean solvent holding tank 20. A portion of the cleaned solvent is transferred from the holding tank 220 to the basin 212 by a transfer pump 224. The solvent transferred to the basin 212 is thereafter recirculated by wash pump 228 and discharged from a spout, hose, nozzles, or other discharge means 229 into the work area 213 for cleaning articles therein. The cleaning solution then returns to the basin 212 for reuse. Once the cleaning solution in the basin 212 becomes substantially contaminated with grease, oils, dirt and other contaminants, the lid 218 is closed to seal off the upper portion 210 (including the work area 213 and basin 212) and vacuum pump 230 is activated to create a vacuum in the upper portion 210 of the apparatus 200. A heating element 232 is thereafter activated to boil the contaminated cleaning solution, creating vapors which are directed through a tube 236, or other passageway, leading to a condenser 238. The vacuum pump 230 further drives a fan 240 to create an air flow, as indicated by the arrows in FIG. 6, past the condenser to cool the vapors therein. After condensing to a liquid state, the purified cleaning solution is directed from condenser 238 to a receiving tank 242. From the receiving tank 242, the purified cleaning solution is released into the clean solution holding tank 220.

While the invention has been shown and described in what is considered to be a practical and preferred embodiment, it is recognized that departures may be made within the spirit and scope of the following claims which, therefore, should not be limited except within the doctrine of equivalents.

Now that the invention has been described, What is claimed is:

1. A process for recycling cleaning solution in an industrial washing apparatus, said process comprising the steps of:

providing at least one holding tank for containing a charge of the cleaning solution therein;

providing a wash basin including an at least partially surrounding wall structure and a floor having a drain means therein for draining the solution from said wash basin into said holding tank;

providing a drain passage between said wash basin and said holding tank for permitting gravitational flow of the cleaning solution from within said wash basin and into said holding tank;

providing a distillation chamber structured and disposed to receive the charge of cleaning solution therein;

providing a transfer passage between said holding tank and said distillation chamber to permit gravitational fluid flow of the cleaning solution from within said holding tank and into said distillation chamber;

maintaining said wash basin above said holding tank;

maintaining said holding tank above said distillation chamber;

containing the charge of the cleaning solution in said holding tank;

pumping the cleaning solution into said wash basin for washing articles therein;

returning the cleaning solution from said wash basin, by gravitational flow through said drain passage, to said holding tank;

periodically opening a transfer valve below said holding tank and releasing the entire charge of cleaning solution from within said holding tank, after becoming contaminated from use during washing, causing the entire charge of cleaning solution and contaminants in the holding tank to be flushed, by gravitational flow, into said distillation chamber below said holding tank;

sealing said transfer passage between said holding tank and said distillation chamber to prevent vapors from rising from said distillation chamber into said holding tank and to prevent air flow between said holding tank and said distillation chamber;

sealing said drain passage between said wash basin and said holding tank when the washing apparatus is not being used for washing operations, to prevent cleaning solution vapors from escaping from within said holding tank into the surrounding atmosphere;

heating the contaminated charge of cleaning solution to a predetermined temperature in said distillation chamber to cause vaporization of the cleaning solution and, thereby, producing cleaning solution vapors which are separated from non-vaporized contaminants;

directing said cleaning solution vapors away from said distillation chamber and condensing said cleaning solution vapors to yield purified, condensed liquid cleaning solution; and returning the purified liquid cleaning solution to said holding tank for subsequent use to wash articles in said wash basin.

2. A process as recited in claim 1 further comprising the step of rinsing said holding tank with a portion of said cleaning solution, after said step of periodically releasing the charge of cleaning solution into said distillation chamber, to wash remaining contaminants into said distillation chamber.

3. A process as recited in claim 1 further comprising the step of creating a negative pressure in said distillation chamber, prior to said step of heating the contaminated charge of cleaning solution, to thereby lower the temperature at which said contaminated charge of cleaning solution will vaporize.

4. A process as recited in claim 1, wherein after the step of returning the purified liquid cleaning solution to said holding tank, the method further comprises the steps of:

cooling said charge of the cleaning solution in said holding tank; and maintaining said charge of the cleaning solution in said holding tank at a predetermined cooled temperature.

5. A process as recited in claim 1 wherein, after the step of condensing, the process includes the step of:

directing the purified liquid cleaning solution to a second holding tank.

6. A process as recited in claim 5 further comprising the step of transferring said purified liquid cleaning solution from said second holding tank to said holding tank for subsequent use during washing of articles.

7. A process as recited in claim 1 further comprising the step of periodically cleaning said distillation chamber to remove accumulated contaminants.

8. A process for recycling cleaning solution in an industrial washing apparatus, said process comprising the steps of:

providing at least one holding tank for containing a charge of the cleaning solution therein;

providing a wash basin including an at least partially surrounding wall structure and a floor having a drain means therein for draining the solution from said wash basin into said holding tank;

providing a drain passage between said wash basin and said holding tank for permitting gravitational flow of the cleaning solution from within said wash basin and into said holding tank;

providing a distillation chamber structured and disposed to receive the charge of cleaning solution therein;

providing a transfer passage between said holding tank and said distillation chamber to permit gravitational fluid flow of the cleaning solution from within said holding tank and into said distillation chamber;

maintaining said wash basin above said holding tank;

maintaining said holding tank above said distillation chamber;

containing the charge of the cleaning solution in said holding tank;

pumping the cleaning solution into said wash basin for washing articles therein;

returning the cleaning solution from said wash basin, by gravitational flow through said drain passage, to said holding tank;

periodically opening a transfer valve below said holding tank and releasing the entire charge of cleaning solution from within said holding tank, after becoming contaminated from use during washing, causing the entire charge of cleaning solution and contaminants in the holding tank to be flushed, by gravitational flow, into said distillation chamber below said holding tank;

sealing said transfer passage between said holding tank and said distillation chamber to prevent vapors from rising from said distillation chamber into said holding tank and to prevent air flow between said holding tank and said distillation chamber;

sealing said drain passage between said wash basin and said holding tank when the washing apparatus is not being used for washing operations, to prevent cleaning solution vapors from escaping from within said holding tank into the surrounding atmosphere;

creating a negative pressure within said distillation chamber;

heating the contaminated charge of cleaning solution to a predetermined temperature in said distillation chamber to cause vaporization of the cleaning solution and, thereby, producing cleaning solution vapors which are separated from non-vaporized contaminants;

directing said cleaning solution vapors away from said distillation chamber and condensing said cleaning solution vapors to yield purified, condensed liquid cleaning solution; and returning the purified liquid cleaning solution to said holding tank for subsequent use to wash articles in said wash basin.

9. A process as recited in claim 8 further comprising the step of rinsing said holding tank with a portion of said cleaning solution, after said step of periodically releasing the charge of cleaning solution into said distillation chamber, to wash remaining contaminants into said distillation chamber.

10. A process as recited in claim 8, wherein after the step of returning the purified liquid cleaning solution to said holding tank, the method further comprises the steps of:

cooling said charge of the cleaning solution in said holding tank; and maintaining said charge of the cleaning solution in said holding tank at a predetermined cooled temperature.

11. A process as recited in claim 8 wherein, after the step of condensing, the process includes the step of:

directing the purified liquid cleaning solution to a second holding tank.

12. A process as recited in claim 11 further comprising the step of transferring said purified liquid cleaning solution from said second holding tank to said holding tank for subsequent use during washing of articles.

13. A process as recited in claim 8 further comprising the step of periodically cleaning said distillation chamber to remove accumulated contaminants.

* * * * *